US009551223B2

(12) United States Patent
Willis

(10) Patent No.: US 9,551,223 B2
(45) Date of Patent: Jan. 24, 2017

(54) FLUID STREAM DRIVEN WOBBLE PLATE MOTOR

(71) Applicant: Jerry F. Willis, Houston, TX (US)

(72) Inventor: Jerry F. Willis, Houston, TX (US)

( * ) Notice: Subject to any disclaimer, the term of this patent is extended or adjusted under 35 U.S.C. 154(b) by 772 days.

(21) Appl. No.: 13/998,080

(22) Filed: Sep. 30, 2013

(65) Prior Publication Data

US 2014/0037428 A1 Feb. 6, 2014

Related U.S. Application Data

(63) Continuation-in-part of application No. 12/583,368, filed on Aug. 19, 2009, now Pat. No. 8,545,176.

(51) Int. Cl.

| | |
|---|---|
| ***F01D 5/02*** | (2006.01) |
| ***F04B 35/00*** | (2006.01) |
| ***F01D 1/02*** | (2006.01) |

(52) U.S. Cl.

CPC ..... *F01D 5/026* (2013.01); *F01D 1/026* (2013.01); *F04B 35/00* (2013.01); *F04B 35/008* (2013.01)

(58) Field of Classification Search

CPC ..... F01D 1/026; F01D 5/021; F01D 5/025; F01D 5/026; F01D 5/027; F01D 5/3061; F04B 35/00; F04B 35/008; F16H 1/12; F16H 1/14; F16H 1/222; F16H 1/24; F16H 55/10; F16H 57/038; F16H 2055/173; B23Q 5/045; B25J 17/0283

USPC . 92/261; 415/202; 416/202; 418/49; 74/416, 417

See application file for complete search history.

(56) References Cited

U.S. PATENT DOCUMENTS

| | | | | |
|---|---|---|---|---|
| 2,097,138 | A | 10/1937 | Steele | |
| 2,645,111 | A | 7/1953 | Fields | |
| 2,897,761 | A | 8/1959 | Roy | |
| 3,120,353 | A | 2/1964 | Neidl | |
| 3,320,896 | A * | 5/1967 | Roy, Jr. | F04D 11/005 415/70 |
| 4,235,116 | A | 11/1980 | Meijer | |
| 4,722,660 | A | 2/1988 | Akamatsu | |
| 4,924,718 | A * | 5/1990 | Glover | F16H 23/00 472/1 |
| 5,178,515 | A | 1/1993 | Tsuchiya | |
| 5,486,142 | A | 1/1996 | Folsom | |
| 5,493,862 | A | 2/1996 | Folsom | |
| 5,524,437 | A | 6/1996 | Larkin | |
| 5,529,468 | A | 6/1996 | Tuck | |
| 5,531,072 | A | 7/1996 | Larkin | |
| 5,642,617 | A | 7/1997 | Larkin | |
| 5,896,745 | A | 4/1999 | Folsom | |
| 6,003,480 | A | 12/1999 | Quayle | |
| 6,062,022 | A | 5/2000 | Folsom | |
| 6,177,735 | B1 | 1/2001 | Chapman | |
| 6,248,037 | B1 | 6/2001 | Foster | |
| 6,417,578 | B1 | 7/2002 | Chapman | |
| 6,506,012 | B2 | 1/2003 | Tuck | |

(Continued)

*Primary Examiner* — Dwayne J White
*Assistant Examiner* — Alexander White
(74) *Attorney, Agent, or Firm* — G. Turner Moller

(57) ABSTRACT

Several embodiments of a wobble plate motor include a disc mounted on a bent shaft. Driving the wobble plate so it revolves on a flat base causes the bent shaft to rotate and drive a generator or other work consumer. The wobble plate may be driven by a fluid stream impinging on the plate or by a blade assembly in a path of fluid movement. In one embodiment of a bladed motor, a shroud may direct the fluid stream so it more efficiently cooperates with the blade assembly.

19 Claims, 4 Drawing Sheets

(56) References Cited

U.S. PATENT DOCUMENTS

| | | | | |
|---|---|---|---|---|
| 6,941,900 | B1 | 9/2005 | Malinov | |
| 7,055,507 | B2 | 6/2006 | Kelley | |
| 8,403,622 | B2 | 3/2013 | Cochran | |
| 8,545,176 | B2 * | 10/2013 | Willis | F04B 35/00 415/202 |

* cited by examiner

FLUID STREAM DRIVEN WOBBLE PLATE MOTOR

This application is partly based on Provisional Application Ser. No. 61/848,623, filed Jan. 7, 2013, the priority of which is claimed and is a continuation-in-part of application Ser. No. 12/583,368, filed Aug. 19, 2009.

This invention relates to a wobble plate or swash plate motor and more particularly to a such a motor driven by a high inertia fluid stream.

BACKGROUND OF THE INVENTION

There has been considerable development of gas turbine driven electrical generators. Typical modern devices incorporate several energy recovery techniques including making steam with heat from hot exhaust gases exiting from the gas turbines.

Wobble plate or swash plate devices are known in the prior art where a wobble plate comprises a transmission between a device applying a force to the wobble plate and an output device. Thus, the wobble plate devices are transmissions between a prime mover and an output device, some of which are pumps. The force applied to wobble plate is often by a cylinder or piston.

Other bladed motors of various types are also known in the prior art.

SUMMARY OF THE INVENTION

In one aspect, an inclined plate is mounted on a bent rotatable shaft and rotated so the plate rolls on a planar surface. Thus, the plate may roll on a base or track and cause rotation of the shaft which may be connected to a work consumer, such as an electrical generator, pump, compressor or the like. When rolling on the base, the inclined plate moves in a manner analogous to a spinning coin as it begins to decay, i.e. when the spin rate slows to a value where the coin is inclined to its axis of rotation. This type of motion has been defined as nutation, i.e. the disc nutates.

In some embodiments, the track on which the inclined plate runs is of a non-skid design so the inclined plate does not skid but is, instead, induced to roll on its track. It may be preferred to provide the track and plate with gear teeth providing the non-skid device.

A force is applied to the inclined plate in any suitable manner causing it to roll on its base. In one embodiment, nozzles direct a propulsion fluid only onto segments of the plate that drive it in the same direction. In some embodiments, energy may be recovered from a rapidly moving fluid stream, such as the exhaust of a gas turbine, or a slower stream of higher fluid density, such as a moving liquid.

In another embodiment, a wobble blade assembly is mounted in a housing and includes a fan or blade assembly which is rotatably mounted on the end of a bent drive shaft. The drive shaft includes an opposite end mounted for rotation in a suitable support in the housing. A gear fixed to the housing meshes with teeth on the periphery of the fan blade assembly. A moving fluid stream passes through the housing and impacts the blade assembly to induce rotation of the blade assembly around the fixed gear thereby rotating the drive shaft. The drive shaft may be coupled to a work consuming device, such as an electrical generator, pump or the like.

It is an object of this invention to provide a wobble plate motor in which an inclined plate is mounted on the end of a bent shaft.

Another object of this invention is to provide a wobble plate motor in which high pressure fluid is applied directly to a section of the wobble plate thereby rotating the wobble plate and driving a work consumer.

A further object of this invention is to provide a wobble plate motor operated by a bladed rotor drive by a stream of moving fluid.

These and other objects and advantages of this invention will become more fully apparent as this description proceeds, reference being made to the accompanying drawings and written description.

DETAILED DESCRIPTION OF THE INVENTION

Any of the embodiments may be driven by a high inertia fluid stream. The fluid stream may be a liquid stream moving at a moderate velocity or a gas or vapor stream moving at higher velocity. In one application, the gas stream may be the exhaust of a gas turbine, such as of the type used to drive large electrical generators. One of the advantages of this invention is that energy is taken from the inertia of the fluid stream, such as by reducing the velocity of a gas stream, without substantially changing the temperature of the gas stream significantly. In this manner, this invention may be used in conjunction with a thermal energy recovery system, as by using the hot exhaust gases exiting from this device in a steam cycle.

Figure 1:
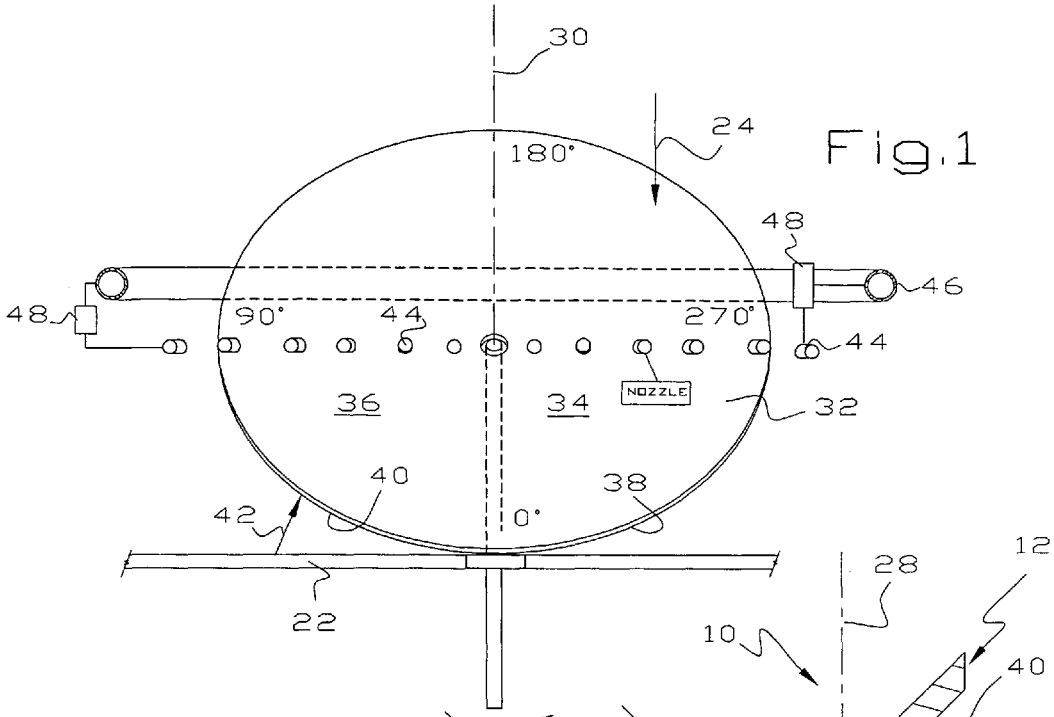
FIG. 1 is a front view of one embodiment of a wobble plate motor, certain parts being broken away for clarity of illustration.
Figure 3:
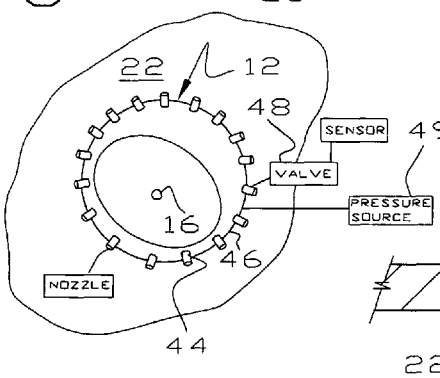
FIG. 3 is a schematic top view of the motor of FIGS. 1-2 illustrating one technique for applying fluid pressure to only one side of the plate.
Figure 2:
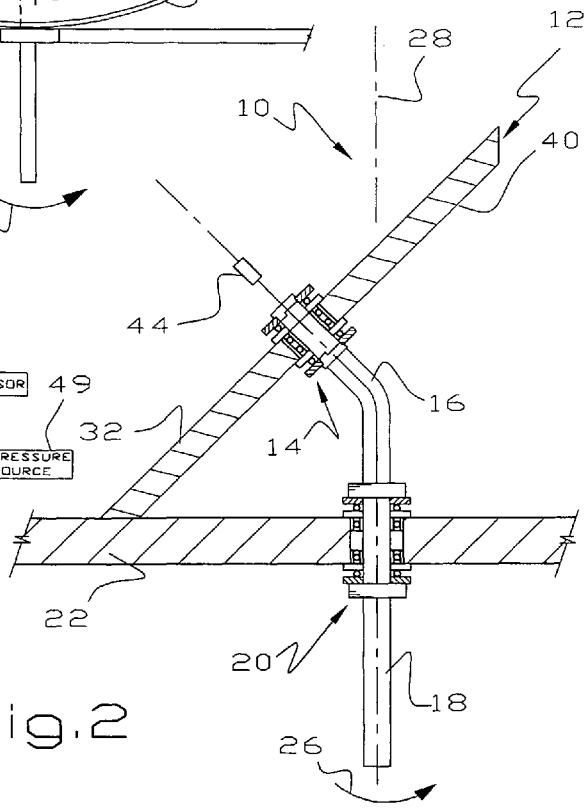
FIG. 2 is a cross-sectional view of the wobble plate motor of FIG. 1, taken in a plane defined by the bent shaft.

Referring to FIGS. 1-3, there is illustrated a simplified wobble plate motor 10 illustrating its principles of operation. The motor 10 comprises a plate or disc 12 journalled or rotatably mounted by a bearing assembly 14 on a bent end 16 of a shaft 18 rotatably mounted by a bearing assembly 20 in a planar base 22 perpendicular to the shaft 18. If necessary or desirable, the bearing assemblies 14, 20 may include thrust elements to counteract any tendency of the shaft 18 to move axially. The concept is that a force applied to only one segment of the disc 12, as in the direction of the arrow 24, causes the disc 12 to roll on the planar base 22 and thereby rotate the shaft 18 in the direction shown by the arrow 26 thereby driving an input to a work consumer such as an electrical generator, pump, compressor or the like.

Thus, the plate 12 rotates about an axis 28 of the shaft 18 in a manner analogous to a spinning coin as it begins to decay, i.e. as the spin rate slows to a value where the coin is inclined to its axis of rotation. In other words, the plate 12 nutates as it rolls on a track provided by the base 22.

The force applied to the plate 12 is generated by a differential pressure applied directly to the plate 12 as contrasted to a pressure generated force applied through a cylinder, piston or other mechanical device. Although the differential pressure may be the difference between atmospheric pressure and a partial vacuum, it may be preferred to provide a positive pressure to only one segment of the disc 12 because much greater positive pressures are more readily available and produce much greater torque on the output shaft 18. Although the power fluid may be a liquid, it may be preferred to use a gas, such as steam which is readily available in some industrial environments of which one example is the exhaust from steam turbines.

As shown in FIG. 1, an imaginary plane 30 is defined by the shaft 18 and its bent end 16 to divide a front 32 of the disc 12 into two segments 34, 36 to divide the back of the disc 12 into two segments 38, 40. It will be seen that a force applied in the direction of the arrow 24 to the segment 34 causes the disc 12 to rotate in the direction shown by the arrow 26, as does a force applied to segment 40 in the direction shown by the arrow 42. In other words, forces represented by the arrows 24, 42 cause rotation of the disc 12 in the same direction, i.e. as shown by the arrow 26. Similarly, forces applied to the segments 36, 38 cause rotation of the disc 12 in the direction opposite to the arrow 26. Thus, the segments 34, 40 may be considered complementary or additive and the segments 36, 38 may be considered opposite or subtractive relative to the segments 34, 40. The various segments 34, 36, 38, 40 suggest a myriad of ways in which pressures, or partial vacuums, may be applied to the disc 12 to induce rotation of the shaft 18 in a desired direction.

As used herein, saying that pressure is applied to only one segment of the disc 12 may mean that the disc is subject to greater pressures inducing rotation in one direction rather than in the other direction, such as will occur when high pressure is applied to one segment of the disc 12 and atmospheric pressure is applied to an opposite or subtractive segment.

There are a variety of ways to apply pressure to only one segment of the plate 12 and not to its opposite. As shown in FIG. 1-3, one or more horizontal arrays of nozzles 44 may be supported in any suitable manner, such as on a ring header 46, about the disc 12 so that one or more nozzles 44 is always aimed at or near a given point on the disc 12 such as the imaginary marking 270°. The nozzles 44 are actuated sequentially so that one or more of them discharge power fluid onto the plate 12 toward one or more of the selected plate segments inducing rotation in the desired direction. This may be accomplished in any suitable manner, a simple version of which may be that each nozzle includes a valve 46 having a sensor, such as a feeler, positioned to be tripped by an edge or a detectable marker on the plate 12 as it approaches the nozzle 44 to deliver high pressure fluid from a source 49.

Each of the nozzles 44 is connected by a valve 48 to a pressure source 49 so by judiciously operating selected ones of the valves 48, a high pressure fluid is delivered through the nozzle 44 aimed at the 270° mark, the disc 12 will rotate or nutate about the axis 18 in the direction of the arrow 26. The nozzles 44 may extend completely around the disc 12 as shown in FIG. 3 so one or more of the nozzles 44 aimed at the back 38 of the disc 12 may simultaneously be actuated to deliver power fluid to the back of the imaginary marking 90°, i.e. at the complementary segment 40. This effectively doubles the force applied to the disc 12 and thus doubles the usable output of the shaft 18.

Operation of the motor 10 will now be described. When motive fluid is delivered by the nozzles 44 to the segment 34 and/or to the segment 40, the disc 12 rolls on the base 22 because the pressure and thus the force applied to the complementary disc segments 34, 40 is greater than atmospheric pressure acting on the subtractive segments 36, 38. This rotates the shaft 18 and provides torque and horsepower to operate a work consuming device.

Figure 4:
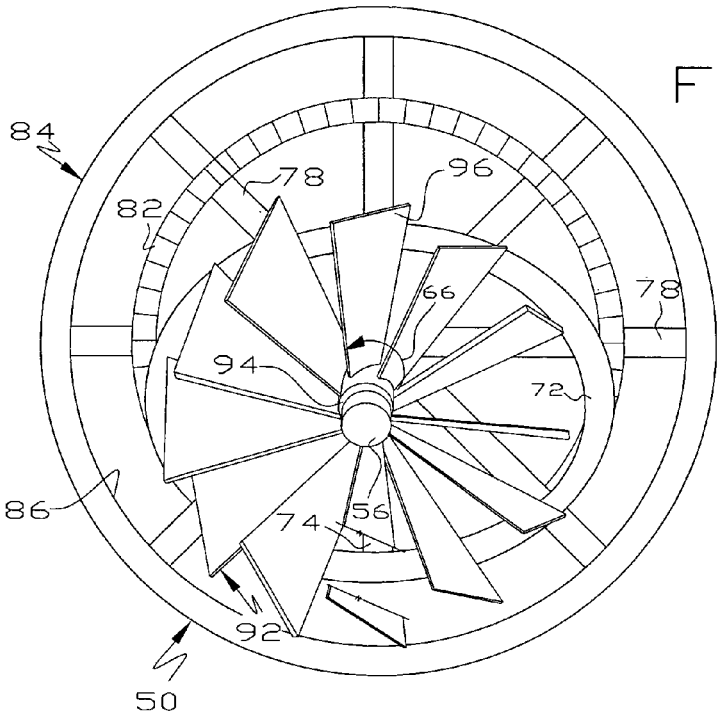
FIG. 4 is a front view of another embodiment of a wobble plate motor, certain parts being broken away for clarity of illustration.
Figure 5:
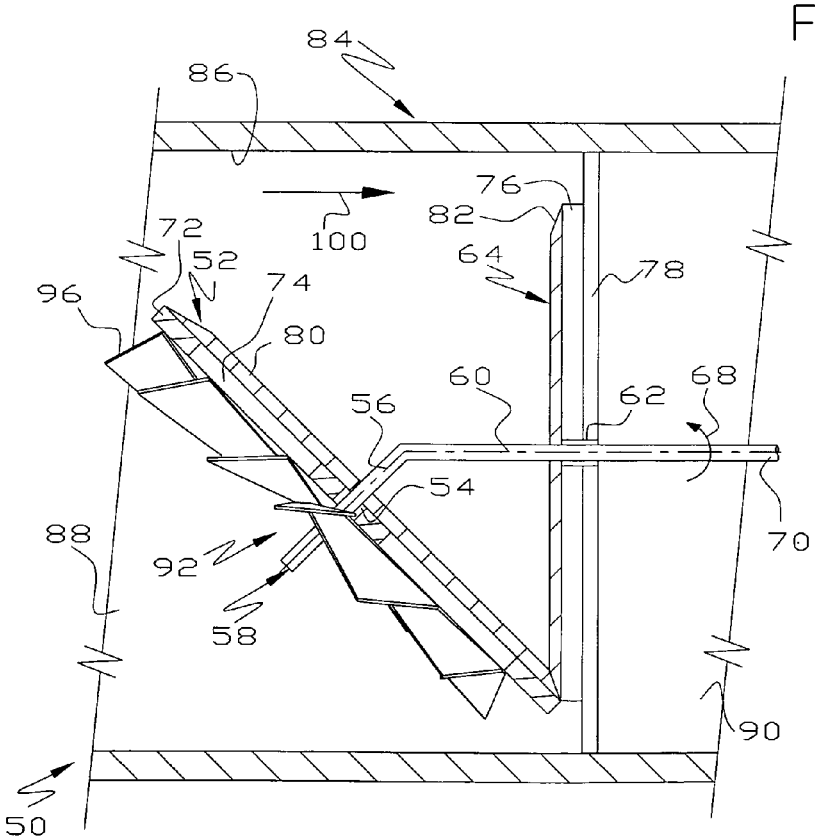
FIG. 5 is a side view of the motor of FIG. 4, certain parts being broken away for clarity of illustration.

Referring to FIGS. 4-5, there is illustrated another embodiment comprising a motor 50 having a member 52 such as a plate, disc, tube or the like journalled or rotatably mounted by a bearing assembly 54 on a bent end 56 of a shaft 58 rotatably mounted about an axis 60 by a bearing assembly 62 in a planar base 64. If necessary or desirable, the bearing assemblies 54, 62 may include thrust elements to counteract any tendency of the shaft 58 to move axially. From one point of view, the concept is that a force applied to the disc 52, as in the direction of the arrow 66, causes the plate 52 to roll on the planar base 64 and thereby rotate the shaft 58 in the direction shown by the arrow 68 thereby driving an input to a work consumer such as an electrical generator, pump, compressor or the like drivably connected to the shaft end 70. From another point of view, the concept is that a force applied to the disc 52, as in the direction of the arrow 66, causes the shaft 58 to rotate in the direction of the arrow 68 while the plate 52 cooperates with the base 64 to constrain movement of the shaft end 70 into simple rotary movement about the axis 60.

The member 52 may preferably include a ring or rim 72 and a plurality of radiating struts 74 providing a receptacle for the bearing 54. This allows the motive fluid to flow through the member 52 for purposes more fully apparent hereinafter. The base 64 may be of similar construction providing a ring 76 and a series of radiating struts 78. To make the plate 52 roll on the base 64 without slipping, a gear or gear teeth 80 on the plate 52 may mesh with a gear or gear teeth 82 on the base 64. It will be seen that the gear teeth 80, 82 provide complementary bevel gears. It will also be seen that the rings 72, 76 may be of equal diameter or may be of different diameter, meaning that the gears 80, 82 may be of different or the same diameter.

The motor 50 may be positioned in a housing 84 of any suitable type and is illustrated as a simple tubular housing having a passage 86, an inlet end 88 and an outlet end 90. The struts 78 may extend to connect to the housing 84 thereby positioning the motor 50 at a desired location. The plate 52 and base 64 may accordingly comprise latticework arrangements in the sense that a fluid flowing through the housing passage 86 is only minimally obstructed.

Driving the shaft 58 or the plate 52, depending on ones view, is a blade assembly 92 mounted on the bent end 56 of the shaft 58. The blade assembly 92 may include the bevel gear provided by the teeth 80. The blade assembly 92 may include a hub 94 and a series of blades 96 radiating away from the hub 94. The blade assembly 92 is fixed to the gear 80 and the blades 96 are inclined so that, on one side of the blade assembly 92, the blades 96 present a more-or-less solid appearance (such as on the left in FIG. 4) and a more-or-less open appearance (such as on the right of FIG. 4). As the plate 52 nutates on its circular edge around and in cooperation with the ring 76, the plate 52 and shaft rotates relative to each other as allowed by the bearing 54. Manifestly, the inclination of the blades 96 can be reversed to cause rotation of the blade assembly 92 in the opposite direction. As an alternative, the blades 96 may be of airfoil shape and suitably positioned to produce torque to drive the plate 52 and the shaft 58.

High inertia fluid flowing through the passage 86 in the direction shown by the arrow 100 impacts the blades 96 on the left in FIG. 4 and tends to flow freely through the blades 96 on the right in FIG. 4. This pushes the blade assembly 92 to the left in FIG. 4 causing nutation of the blade assembly 92 as it tracks along the stationary bevel gear 82. The axial shaft 70 is accordingly rotated and may be connected to a work producing device such as an electrical generator, pump or the like thereby producing work. It will accordingly be seen that the blade assembly 92 nutates during operation of the motor 50 thereby rotating the output shaft 70.

Figure 6:
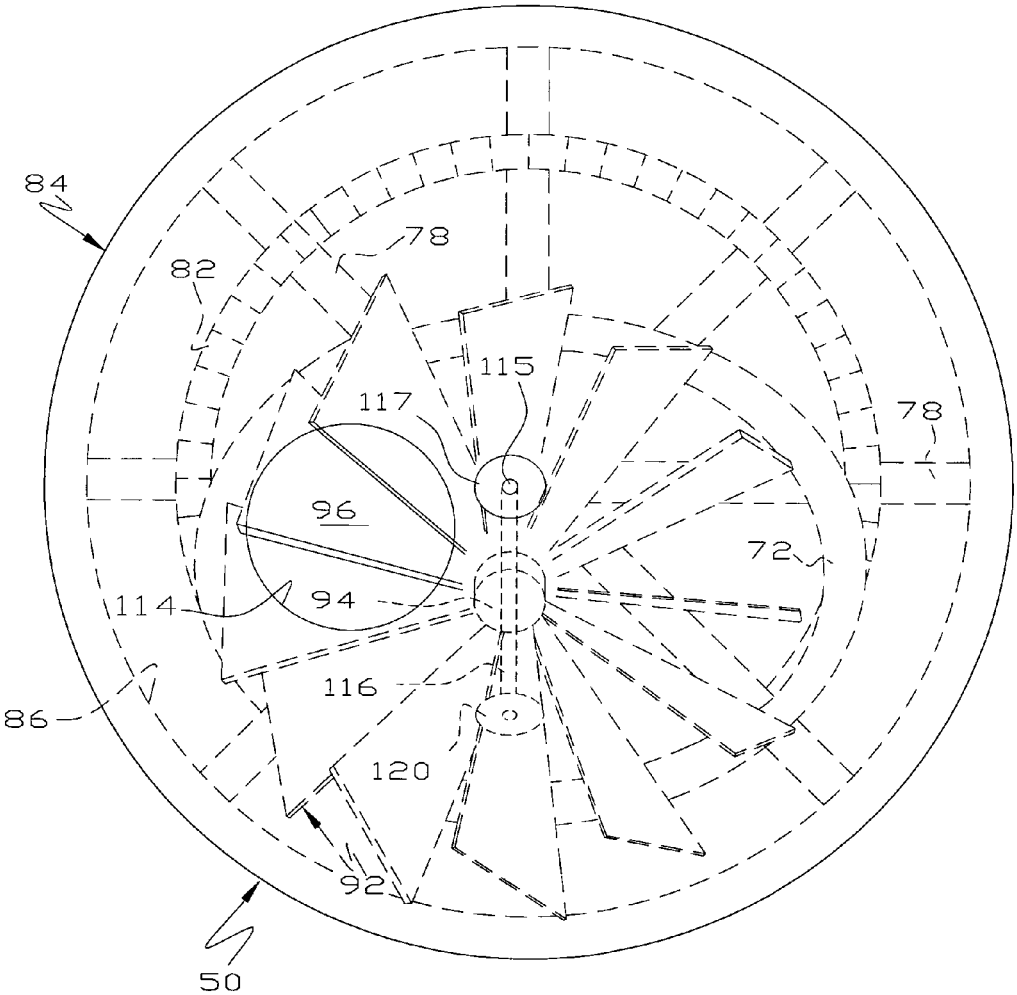
FIG. 6 is a front view of a modified form of the embodiment of FIGS. 4-5 illustrating a shroud in front of the fan assembly to control fluid flow.
Figure 7:
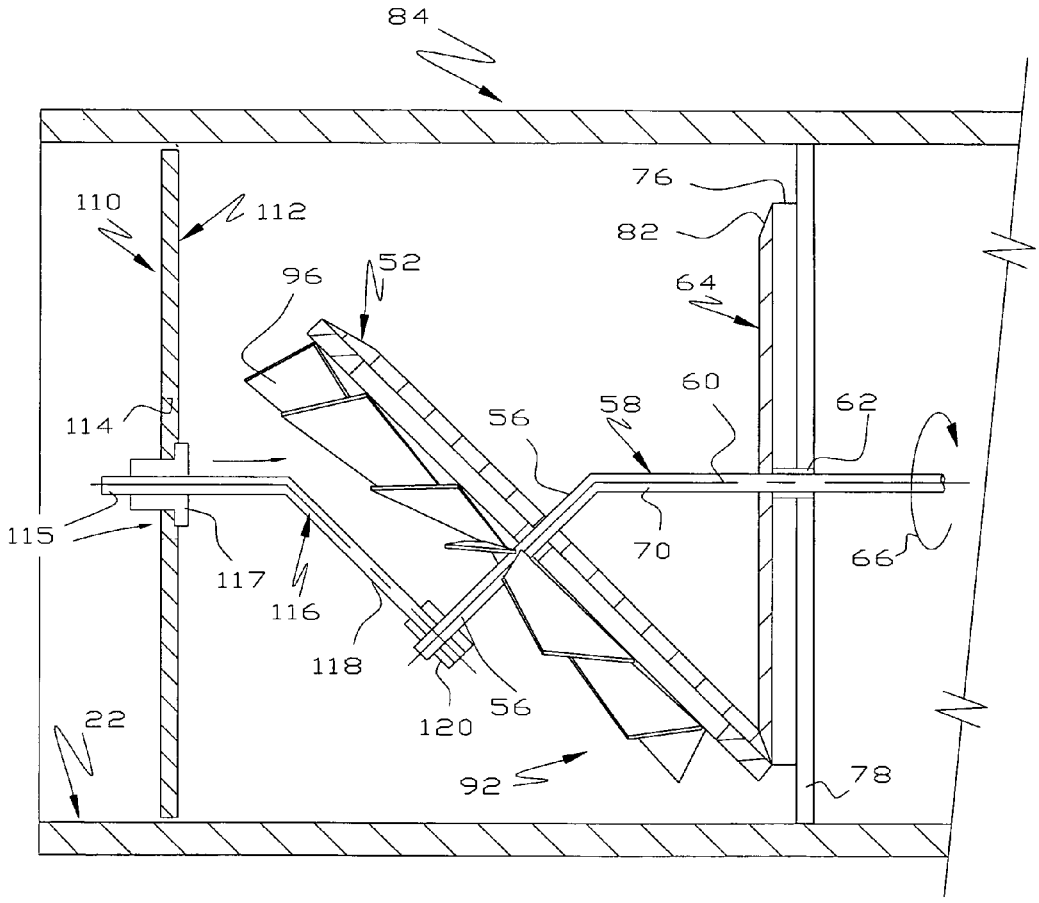
FIG. 7 is a side view of the motor of FIG. 6, certain parts being broken away for clarity of illustration.

There is a tendency of air flowing through the passage 86 to bypass the blade assembly 92 reducing the efficiency of the motor 50. It may be preferred to provide a shroud 110 to divert air through the blade assembly 92 as shown in the embodiments of FIGS. 6 and 7. The shroud 110 may act as a flow director, directing flow only toward the blades 96 which are transverse to, or side-on to, the direction of flow through the housing 84. The shroud 110 may also act as a flow accelerator as will be more fully apparent hereinafter.

The shroud 110 may take a number of suitable forms and may include a plate 112 having an opening 114 aligned with those fan blades 96 that are side-on to the direction of flow as suggested in FIG. 6.

An important advantage of the embodiment of FIGS. 6-7 is that rotation of the plate 112 and the opening 114 remains synchronized with nutation of the fan assembly 92 so the opening 114 always aligns with the side-on blades. To this end, the plate 112 may rotate at the same rate, or synchronously, with nutation of the fan assembly 92. This is much easier to accomplish when the gears provided by the teeth 80, 82 are the same size because this means that the member 52 nutates and the plate 112 rotates at the same rate.

The plate 112 may be fixed on a shaft end 115 by a coupling 117 coaxial with the axis 60. The shaft end 115 is part of a bent shaft 116 having an inclined end 118 rotatably mounted on the inclined shaft end 56 by a coupling 120. It will be seen that rotation of the fan assembly 92 causes the inclined shaft end 56 to rotate in a circle 122. This causes the inclined end 118 of the shaft 116 to rotate thereby rotating the plate 112 and maintaining the opening 114 aligned with that segment of the blades 96 that act to rotate the fan assembly. The shroud 110 accordingly increases the efficiency of the motor 50 by reducing fluid bypass around the blade assembly 92. It will also be apparent that the opening 114 restricts the area of flow immediately upstream of the blade assembly 92 thereby increasing the velocity of the fluid stream impacting the side-on blades.

The motors 10, 50 are effective in producing work from moving fluid streams of different density, such as air and water, and from fluid streams moving at much different velocities.

The exhaust stream from gas turbine engines is quite high, perhaps too high for efficient use in some of the embodiments disclosed herein. In this event, the exhaust stream may be split and run through motors which are essentially parallel, the size of the passage through which it flows may be increased to decrease the velocity or in some other arrangement. In addition, the exhaust stream may be of sufficient velocity that substantial energy remains after passing through one of the motors disclosed herein. In this event, motors may be placed in series, depending on the tradeoff between efficient use of available energy, capital costs, operating costs and the like.

It will be apparent that suitable seals may be provided at desired locations to minimize leaking of the driving fluid, suitable bearings may be provided to increase reliability and performance and other engineering solutions may be provided to overcome problems which may become apparent.

It will be seen that the discs 12, 52 may be circular or of other smooth arcuate periphery so long as the base 22, 64 is either planar in the case of a circular disc or of complementary shape in the case of a smoothly arcuate periphery, such as an ellipse. It will also be seen that the discs 12, 52 are at an acute angle relative to the bases 22, 64.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A wobble plate motor comprising a shaft having a first section mounted for rotation about an axis and a bent shaft end rigid with the first section and inclined to the rotational axis;

a circular disc journalled on the bent shaft end for movement therewith; and a planar base abutting the circular disc and surrounding the axis, the planar base being inclined to the circular disc;

a blade assembly on the bent shaft end providing a force to the circular disc, the blade assembly being configured to provide a force offset relative to the axis;

the circular disc being mounted to nutate on the planar base so that application of an eccentric force to the circular disc causes the circular disc to nutate on the planar base and rotatably drive the first shaft section about the axis, the blade assembly nutating with the circular disc.

2. The wobble plate motor of claim 1 further comprising a housing having a passage, the circular disc and planar base being in the passage and a member, upstream of the circular disc and partially blocking the passage, the member having an opening therethrough offset relative to the axis and allowing a fluid stream to pass through the opening and striking the blade assembly offset relative to the rotational axis, the member being mounted for rotation contemporaneously with nutation of the blade assembly.

3. The wobble plate motor of claim 2 further comprising a flow director, the flow director rotates at the same rate as the circular disc nutates.

4. The wobble plate motor of claim 2 wherein the blade assembly comprises a series of blades, the blades having a face and an edge, the face being transverse to the axis in a vicinity of the opening and generally parallel to the axis at a location spaced from the opening.

5. The wobble plate motor of claim 1 further comprising a housing having a passage, the circular disc and planar base being in the passage and a flow director, upstream of the circular disc and partially blocking the passage and allowing a fluid stream to pass and strike the blade assembly offset relative to the rotational axis, the flow director being mounted for rotation contemporaneously with nutation of the blade assembly.

6. The wobble plate motor of claim 5 wherein the flow director is mounted for rotation at the same rate as the circular disc nutates.

7. The wobble plate motor of claim 1 wherein the blade assembly is fixed to the circular disc.

8. The wobble plate motor of claim 1 wherein the circular disc and planar base comprise meshing gears.

9. A wobble plate motor comprising a housing having a passage therethrough and including therein a shaft having a first section mounted for rotation about an axis and a bent shaft end rigid with the first section and inclined to the rotational axis;

a blade assembly on the bent shaft end including an arcuate edge and providing a torque to the first shaft section;

a base, abutting the arcuate edge and surrounding the axis, the base being inclined relative to the blade assembly so that application of an eccentric force to the blade assembly causes the blade assembly to nutate on the base and rotatably drive the first shaft section about the axis;

the blade assembly being mounted for nutating movement on the arcuate edge and, in response to nutating movement, rotating the first shaft section.

10. The wobble plate motor of claim 9 further comprising meshing gears connecting the blade assembly and the base.

11. The wobble plate motor of claim 9 further comprising a flow director, upstream of the fan assembly and partially blocking the passage, allowing a fluid stream to pass and strike the blade assembly offset relative to the rotational axis, the flow director being mounted for rotation in response to nutation of the blade assembly.

12. A wobble plate motor comprising a housing having a passage therethrough and including therein a shaft having a first section mounted for rotation about an axis and a bent shaft end rigid with the first section and inclined to the rotational axis;

a member journalled on the bent shaft end for movement therewith;

a base, abutting the member and surrounding the axis, the base being inclined relative to the member, so that application of an eccentric force to the member causes the member to nutate on the base and rotatably drive the first shaft section about the axis;

a blade assembly on the bent shaft end providing a force to the member offset relative to the axis; and a flow director, upstream of the blade assembly and partially blocking the passage, allowing a fluid stream to pass and strike the blade assembly offset relative to the rotational axis, the flow director being mounted for rotation in response to nutation of the member.

13. The wobble plate motor of claim 12 wherein the flow director rotates at the same rate as the member nutates.

14. The wobble plate motor of claim 12 wherein the flow director comprises a plate having an opening therethrough.

15. The wobble plate motor of claim 12 wherein the blade assembly is fixed to the member.

16. The wobble plate motor of claim 12 wherein the member and base comprise meshing gears.

17. The wobble plate motor of claim 16 wherein the gear on the member has the same number of gear teeth as the gear on the base.

18. The wobble plate motor of claim 12 wherein the base is perpendicular to the axis.

19. The wobble plate motor of claim 12 wherein the member comprises a circular disc and the base is inclined at an acute angle relative to the circular disc.

* * * * *